US005263670A

United States Patent [19]

Colbaugh et al.

[11] Patent Number: 5,263,670

[45] Date of Patent: Nov. 23, 1993

[54] CAB SIGNALLING SYSTEM UTILIZING CODED TRACK CIRCUIT SIGNALS

[75] Inventors: Michael E. Colbaugh, Levelgreen; Raymond C. Franke, Glenshaw, both of Pa.

[73] Assignee: Union Switch & Signal Inc., Pittsburgh, Pa.

[21] Appl. No.: 835,299

[22] Filed: Feb. 13, 1992

[51] Int. Cl.[5] ..... B61L 3/24

[52] U.S. Cl. ..... 246/63 R; 246/167 R; 246/194

[58] Field of Search ..... 246/8, 28 R, 63 R, 63 C, 246/167 R, 187 R, 187 A, 193, 194, 196, 197, 249

[56] References Cited

U.S. PATENT DOCUMENTS

| | | | |
|---|---|---|---|
| 966,796 | 8/1910 | Chandeysson | 246/194 X |
| 1,159,315 | 11/1915 | Finnigan | 246/194 |
| 1,299,446 | 4/1919 | Finnigan | 246/194 X |
| 1,302,345 | 4/1919 | Finnigan | 246/194 X |
| 1,399,796 | 12/1921 | Ross | 246/194 |
| 3,038,066 | 6/1962 | Barry | 246/63 CX |
| 3,268,727 | 8/1966 | Shepard | 246/187 A |
| 3,388,250 | 6/1968 | Baughman | 246/187 R |
| 3,800,139 | 3/1974 | Clark | 246/182 C |
| 3,808,425 | 4/1974 | Campbell et al. | 246/8 |
| 3,946,972 | 3/1976 | Grundy | 246/34 CT |
| 4,081,160 | 3/1978 | Devy et al. | 246/167 R X |
| 4,368,862 | 1/1983 | Grundy | 246/28 R |
| 4,451,018 | 5/1984 | Smith et al. | 246/249 X |
| 4,720,067 | 1/1988 | Jaeger | 246/63 R X |

FOREIGN PATENT DOCUMENTS

| | | | |
|---|---|---|---|
| 1236016 | 3/1967 | Fed. Rep. of Germany | 246/8 |

OTHER PUBLICATIONS

"Track Circuit Fundamentals" by Crawford E. Staples, pp. 2 and 3.

Union Switch & Signal Inc., "Railway Signal Equipment" Bulletin 416 formerly designated at RSE-15A1.

*Primary Examiner*—F. J. Bartuska

*Assistant Examiner*—Scott L. Lowe

*Attorney, Agent, or Firm*—Buchanan Ingersoll; George Patrick Baier

[57] ABSTRACT

A railway vehicle cab signalling system providing electrical signals to operate an aspect display unit or the like located on-board a railway vehicle based upon the track circuit signals typically used to operate wayside indicators. A sensor detects the track circuit current as it passes through at least one wheel and axle set on the vehicle. A processor receives an output signal from the sensor and produces a signal to operate the aspect display unit.

15 Claims, 4 Drawing Sheets

CAB SIGNALLING SYSTEM UTILIZING CODED TRACK CIRCUIT SIGNALS

BACKGROUND OF THE INVENTION

1. Field of the Invention

The present invention relates to the art of railway cab signalling systems. More particularly, the invention relates to a system and a method of utilizing typical coded track circuit signals to provide cab signalling information.

2. Description of the Prior Art

Movement of a railway vehicle along a railroad is necessarily limited to one degree of freedom. That is to say, the vehicle can only travel back and forth along the track. It cannot alter its course to avoid other traffic. To prevent railway vehicles on the same track from overtaking each other, a block signalling scheme has been devised whereby the track is divided into segments, or "blocks," of a length greater than the stopping distance of a train. To prevent a problem, only one train is allowed in a particular block at a time. Wayside block indicators positioned before an upcoming block indicate to the locomotive engineer whether or not the block is occupied. If so, the engineer will know to adjust the speed of the train.

The operation of wayside block indicators has been traditionally controlled by the track circuit. The track circuit is essentially an electrical circuit in which the rails in a block complete a connection between an electrical signal transmitter and an electrical signal receiver. Insulating joints may be placed between adjacent blocks to provide electrical separation. When the block is unoccupied, current is allowed to flow through the rails to the receiver. The receiver, such as a relay, can then activate the wayside indicator to display an appropriate aspect. If, however, the block is occupied by any part of a train, shunt paths are created by the presence of wheel and axle sets on the train. Typically, most current is shunted through the wheel and axle set closest to the signal transmitter. Since the current is prevented from reaching the receiver, the wayside indicator will typically give a stop signal or simply no signal at all.

Originally, track circuits utilized only direct current. The block length was limited in these systems due to electrical leakage through the ballast between the rails and foreign ground currents which could enter the system. It was subsequently found that a pulse modulated current would facilitate the use of a more sensitive relay. This increased the operable track circuit length in main-line areas to 15,000 feet or more. It also allowed the track circuit current to carry coded information which could be utilized by the wayside indicators to provide additional signal aspects.

While wayside indicators are generally effective in providing information to the locomotive engineer, their usefulness may be reduced during periods of fog or other inclement weather. Thus, in order to supplement the wayside indicators, cab signalling was developed. Using traffic control indicators located on-board the vehicle, cab signalling provides locomotive engineers with continuous signalling information similar to that provided by wayside indicators.

Present cab signalling systems typically operate using a receiver on a locomotive inductively coupled to the track. Specifically, a pick-up coil is mounted on a supporting structure depending from the locomotive such that the coil is ahead of the leading axle and approximately six inches above the rail. The coil senses the presence of a modulated AC carrier. While sometimes coded to repeat the governing wayside aspect, the frequency of the cab signalling carrier is generally higher than the coded track circuit signal in order to provide effective inductive coupling to the pick-up coil. Thus, a block signalling system having both wayside indicators and cab signalling will generally have two superimposed electrical signals in the track: the coded track circuit signal and the modulated carrier cab signalling signal.

The carrier signal has been a deterrent to more prevalent utilization of cab signalling. This is due, in part, to the distance limitation imposed by the carrier. For example, a cab signalling system having a typical carrier frequency of 100 hertz will have a range of only about 6,000 feet. This may add cost to the overall signalling system since additional wayside equipment is required. Additional insulating joints may also be necessary, further adding cost to the overall system.

In the early 1950s, attempts were made to improve cab signalling systems by eliminating the carrier and detecting the coded track circuit current using magnetic field sensors mounted above the rails. Without the carrier, the track circuit length could be increased to its maximum and system costs could be reduced. The attempts to develop such a system, however, were a failure. This failure has been attributed to interference caused by magnetized tie plates. Since the sensors were mounted above the rails, they sensed the combination of the field from the rail current as well as the effects produced by the tie plates.

SUMMARY OF THE INVENTION

A railway vehicle cab signalling system practicing the present invention provides electrical signals to operate traffic control indicators located on-board a railway vehicle based upon the track circuit signals typically used to operate wayside indicators. Instead of having antenna inductively detecting track circuit current in the rails, the present invention utilizes sensor means detecting the track circuit current as it passes through a shunt path means comprising at least one wheel and axle set on the vehicle. The sensor means may comprise one or more circumscribing toroids having a transformer winding thereon, or alternatively, having a magnetic field sensor mounted in a gap therein. Processing means receive an output signal from the sensor means and produce a signal to operate the on board traffic control indicators.

DETAILED DESCRIPTION OF PRESENTLY PREFERRED EMBODIMENTS

In accordance with the present invention, a railway vehicle cab signalling system may be provided which utilizes the track code signals commonly employed on railways to operate wayside indicators. Thus, the modulated carrier signal of prior art cab signalling systems may be eliminated. Since the cost attributable to such cumulative signalling may be significantly reduced, the invention makes feasible cab signalling in areas, such as main-line regions having long block lengths, where it was previously cost-prohibitive.

Figure 1:
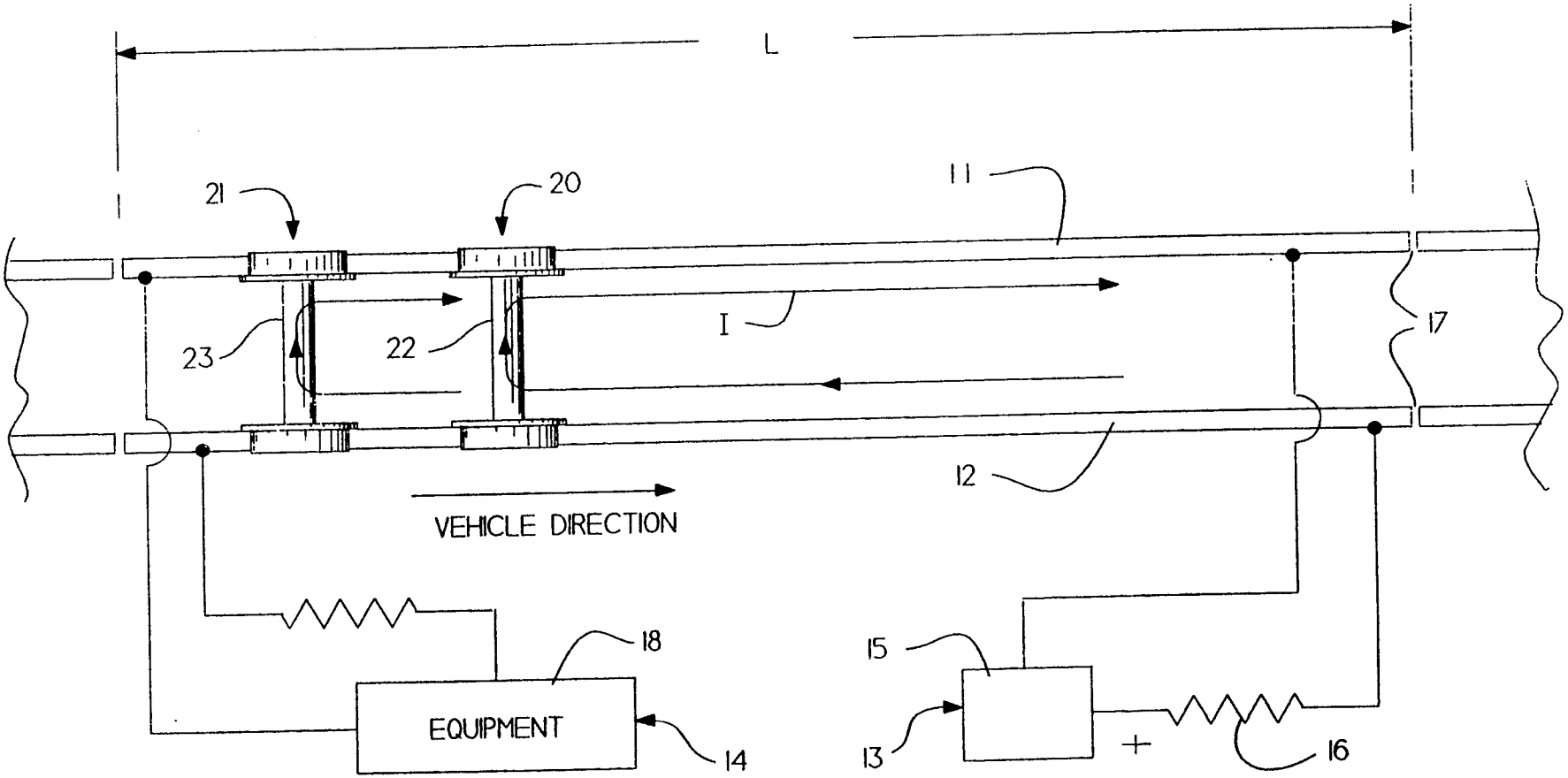
FIG. 1 is a diagrammatic representation of a track circuit showing the presence of a pair of railway vehicle wheel and axle sets across the rails and further indicating the path of travel of the track circuit current.

FIG. 1 illustrates a typical railway track circuit. Rails 11 and 12 are used to transmit a signal between transmitter end 13 of block L and receiver end 14. Transmitter end 13 comprises a track code generator 15 and series resistor 16. Resistor 16 can include both the internal resistance of generator 15 and any external resistance, such as current limiting resistors. As is shown, transmitter end 13 is connected across rails 11 and 12. Because of the presence of insulating joints, such as joint 17, track circuit current I emitted by generator 15 remains in block L and conducts as shown by the arrow. When rails 11 and 12 are clear and no state of broken rail exists within block L, track circuit current I and the encoded information which it carries are received at receiver end 14 and are available to operate equipment 18. Equipment 18 comprises the electronic switching elements to interpret the track current code information to display an appropriate aspect on a wayside indicator. When a train enters block L, shunt paths are created by the presence of vehicle wheel and axle sets, such as 20 and 21, across the rails. This prevents current I from reaching equipment 18. Much of the current I will shunt through leading axle 22. A large portion, however, will also conduct through second axle 23. Thus, while some current is shunted through subsequent axles, the sum of the current in axles 22 and 23 is very near the total of current I.

Figure 2:
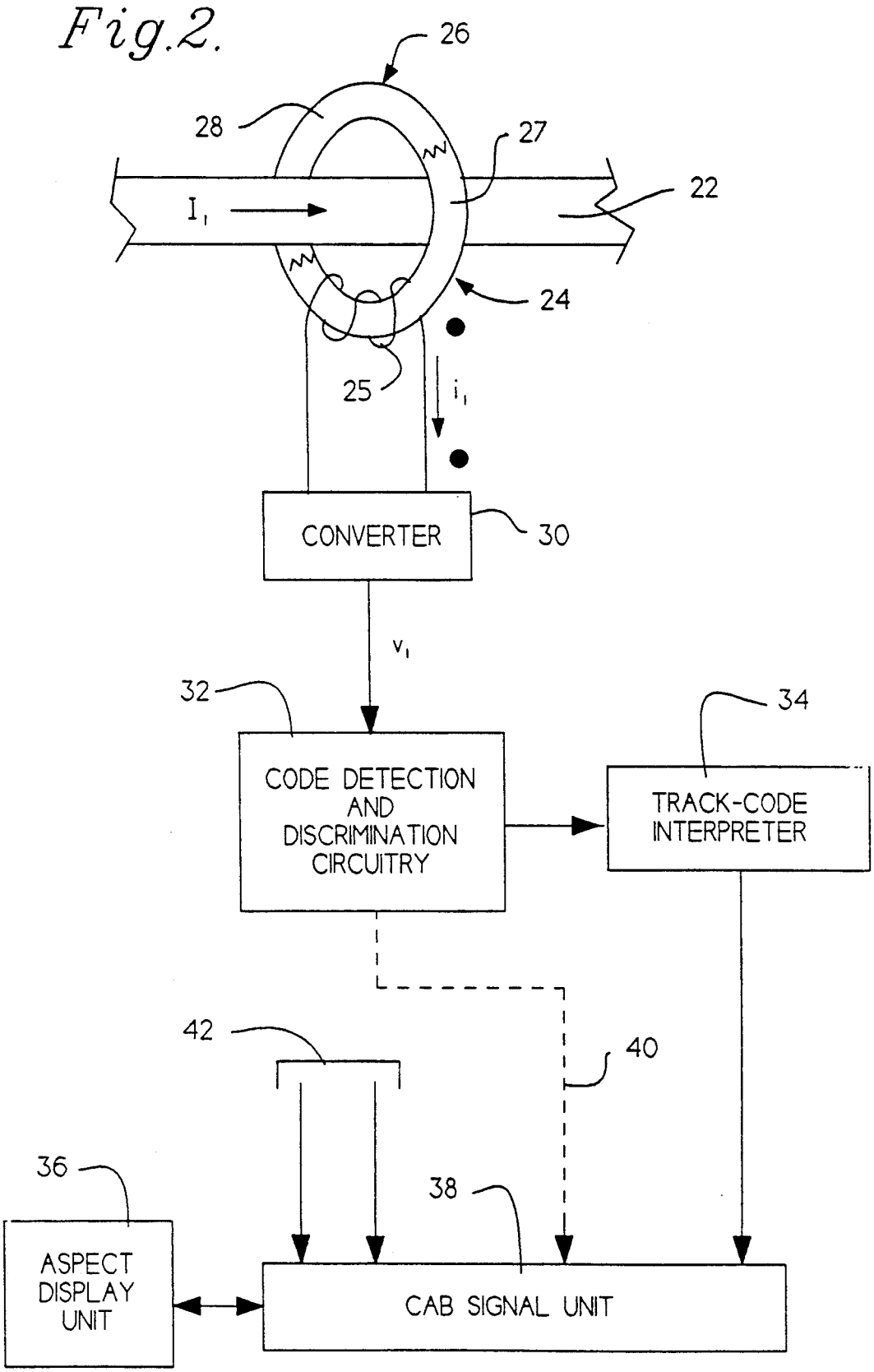
FIG. 2 is a diagrammatic representation of a presently preferred embodiment of a cab signalling system constructed in accordance with the invention wherein the sensor means comprises a transformer having a toroid mounted about a railway vehicle axle.

The present invention utilizes sensor means to detect the magnetic field of the track current as it passes through one or more railway vehicle axle assemblies. Thus, the sensor means may be isolated from magnetic interference such as that caused by magnetized tie plates. The sensor means may comprise transformers or other magneto-sensitive sensors depending upon the exigencies of a particular application. A presently preferred sensor for use with the invention is that shown in U.S. patent application Ser. No. 799,350 filed Nov. 27, 1991 by James P. Chew, incorporated herein by reference. For example, FIG. 2 illustrates a presently preferred embodiment wherein the sensor means comprises a transformer 24 mounted circumscribing leading axle 22. Transformer 24 is a current transformer having a winding 25 making a number of turns about a toroid 26. Axle 22 passes through an opening in toroid 26. Preferably, toroid 26 is constructed of a material having a relatively high magnetic permeability. For ease of mounting, toroid 26 may be of a split core design having two generally semi-circular members 27 and 28.

Current transformers are available from a variety of commercial sources. In addition to ease of mounting, the transformer should preferably have a DC sensitivity in the milliamp range. Other factors to be considered in choosing the appropriate current transformer are durability and general economics. The current transformer and sensor described in the aforementioned application Ser. No. 799,350 presently seems well suited for this purpose.

The passage of a portion $I_1$ of track circuit current I through axle 22 produces a flux in toroid 26 which induces a resulting differential current $i_1$ in winding 25. Current $i_1$ may then be processed by appropriate processing means to operate the on board traffic control indicators. For example, current-to-voltage converter 30 may be provided to convert $i_1$ to a representative voltage signal $v_1$ which changes proportionally in respective polarity and magnitude. The voltage signal $v_1$ can then be fed into code detection and discrimination circuitry 32 to produce an output signal containing track circuit code information. Instead of current-to-voltage converter 30, the processing means may alternatively utilize current comparator circuitry.

In presently preferred embodiments, the output signal of circuitry 32 is in the form of a digital representation of the received code. This digital representation may then be received by track code interpreter 34 to produce a display signal to operate the on-board traffic control indicators, such as aspect display unit 36. Track code interpreter 34 may comprise separate circuitry or may be a part of the hardware or software of cab signal unit 38.

While the invention provides cab signalling information based on the direct detection of track code, the circuitry will also detect the usual cab signalling carrier signal. Thus, it may be desirable to provide an auxiliary output 40 from circuitry 32 to feed received typical cab signals to cab signal unit 38. However, in order to ensure the integrity of the input signals and the correctness of the subsequently activated indicators, it may be desirable to compare the signals and visually or audibly differentiate between standard cab signalling and the track code mode of the invention. Additional inputs 42 into unit 38 are provided for other typical cab signalling inputs, such as a speed sensor, and an optional input for a cab signal antenna of the prior art type.

Figure 3:
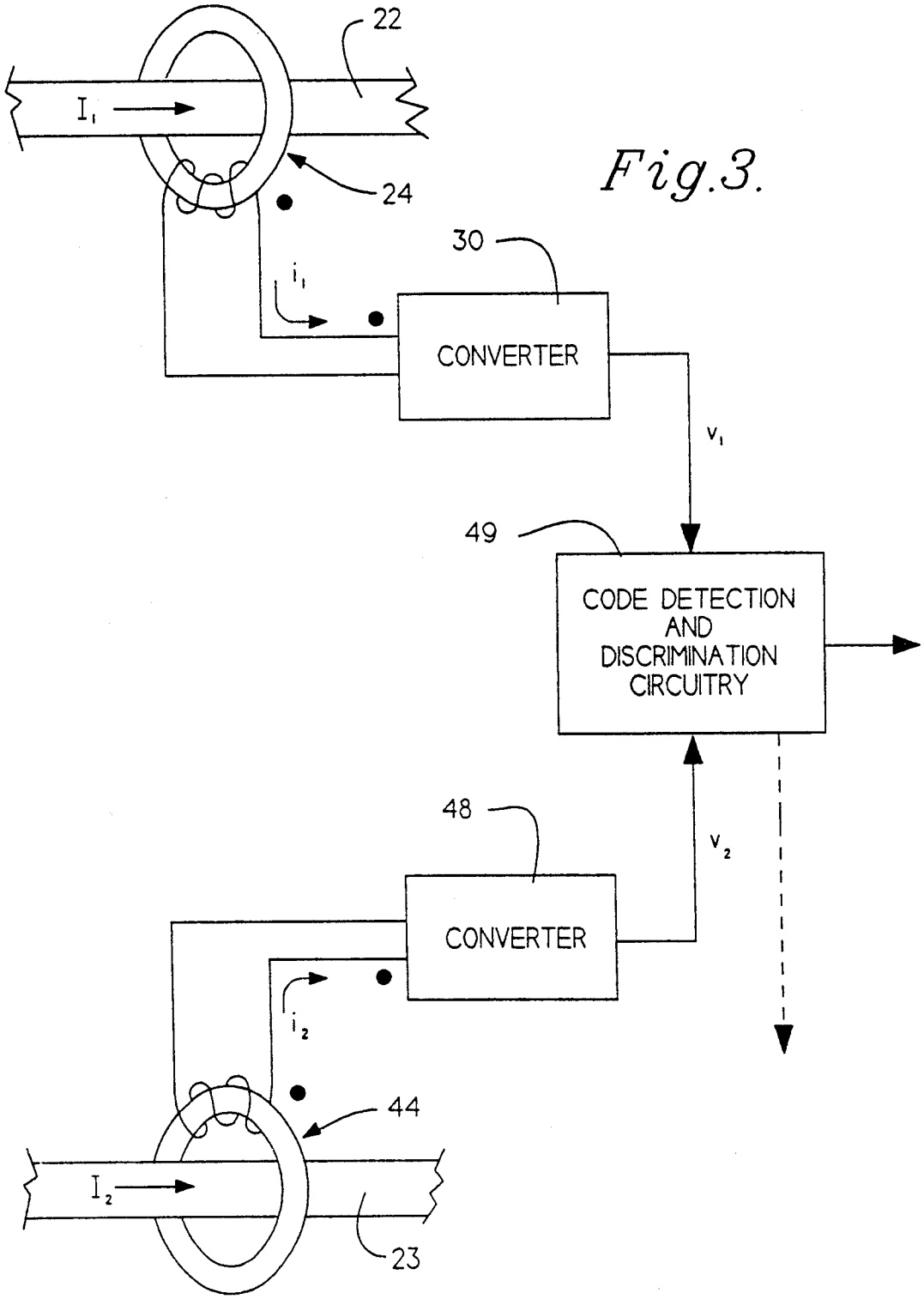
FIG. 3 is a diagrammatic representation of a presently preferred embodiment of a cab signalling system constructed in accordance with the invention wherein the sensor means of the invention comprises a pair of transformers mounted respectively about a first and second railway vehicle axle.

In order to detect a greater portion of track circuit current I, sensors may be placed adjacent several consecutive wheel and axle sets. FIG. 3 illustrates such a multiple sensor configuration. Here, transformer 24 encircles axle 22 producing induced current $i_1$ as in FIG. 2. However, a second current transformer 44 has been added encircling second axle 23. Transformer 44 detects current $I_2$ producing induced current $i_2$. Induced current $i_2$ is fed to current-to-voltage converter 48, producing output voltage $v_2$. Voltages $v_1$ and $v_2$ are then fed to code detection and discrimination circuitry 49 where they are typically summed and processed in the manner of the invention.

Track circuit coding is typically in the form of low-amplitude direct current which is interrupted at code rates of 75, 120 or 180 cycles per minute. The use of a differential transformer with such relatively low frequencies may be undesirable in some applications.

Figure 4:
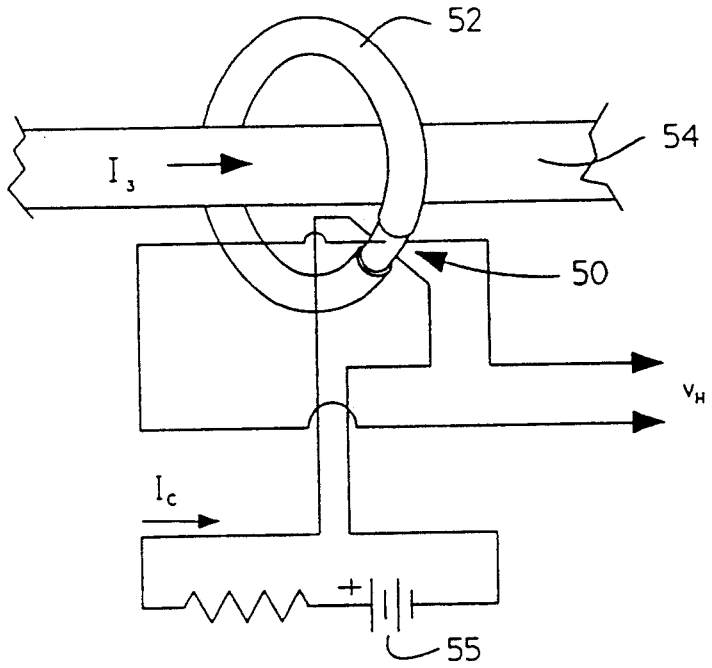
FIG. 4 is a diagrammatic representation of a presently preferred embodiment of a cab signalling system constructed in accordance with the invention wherein the sensor means comprises a magnetic field sensor located in a gap of a toroid mounted about a railway vehicle axle.

Therefore, the invention also contemplates the use of absolute magnetic-field sensors, such as a Hall-effect device. FIG. 4 illustrates a presently preferred embodiment utilizing a Hall-effect sensor 50 mounted within a gap in toroid 52. Alternatively, multiple magnetic field sensors with or without a toroid may be displaced at opposite positions along a diameter of an axle cross-section.

Control current $I_c$ to operate sensor 50 is provided by a current source such as battery 55. The presence of magnetic flux, which has been caused by current $I_3$, through sensor 50 produces Hall voltage $V_H$. Voltage $V_H$ may then be processed in the manner of the invention to operate on-board traffic control indicators.

Figure 5:
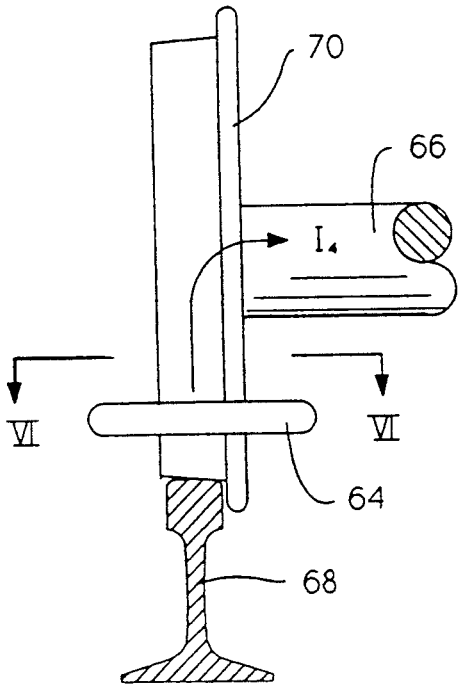
FIG. 5 is a fragmentary view of an alternative presently preferred embodiment wherein the sensor means is mounted between an axle and the rail to detect track circuit current in a wheel.
Figure 6:
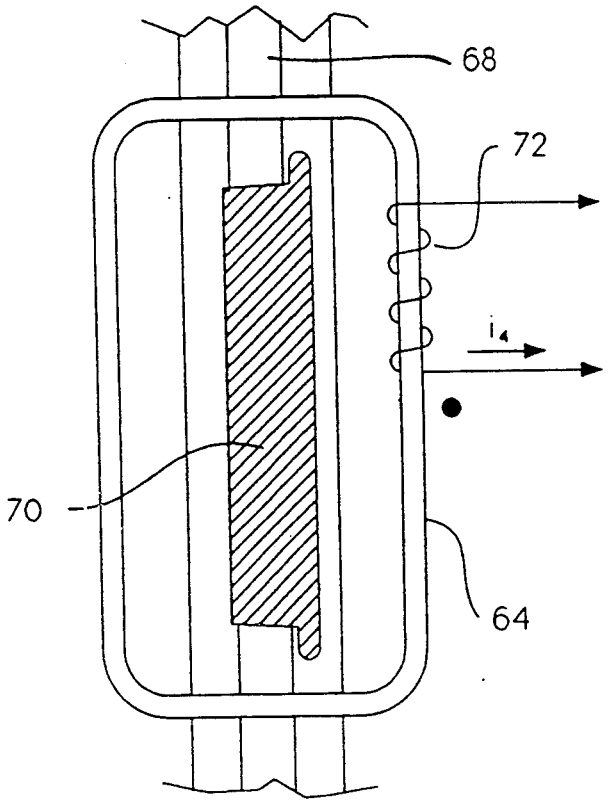
FIG. 6 is a view along line 6—6 of FIG. 5.

FIGS. 5 and 6 illustrate a further alternative placement of the sensor means of the invention. Here, a core member 64 is placed between axle 66 and rail 68, and which circumscribes a portion of wheel 70. A winding 72 or other magneto-sensitive element detects the portion $I_4$ of the track circuit current I passing through wheel 70. Preferably, core member 64 may have a generally rectangular configuration as shown. Core member 64 is preferably mounted generally parallel to rail 68 such that the radius of wheel 70 passes through the opening defined thereby. Thus, current $I_4$ induces current $i_4$ in the transformer which may then be processed to provide cab signalling information.

Certain other variations of the invention may have particular value in specific applications. For example, a magneto optic current transformer may be used. Further, the current transformers can be interconnected in series-aiding fashion and fed into one current-to-voltage converter. Alternatively, it may be advantageous in certain applications to mount the sensors in reverse orientation with respect to each other and the common direction of signal current flow and connect the leads in series-subtracting configuration. This would eliminate injected common-mode noise pickup. Also, active current or voltage mode amplifiers may be used at the sensor cite to reduce sensitivity requirements and provide a better signal-to-noise ratio.

It can thus be seen that a system and a method have been provided to operate cab signalling apparatus based upon the traditional track circuit codes. The need for cab signalling carrier signal has been eliminated. Although certain preferred embodiments have been described and shown herein, it is to be understood that various other embodiments and modifications can be made within the scope of the following claims.

We claim:

1. A railway vehicle cab signalling system for providing electrical signals to operate on-board traffic control indicators based upon coded track circuit signals carried by a track circuit current, said system comprising:

shunt path means comprising at least one railway vehicle wheel and axle set for conducting at least a portion of said track circuit current;

sensor means adjacent said shunt path means for detecting said at least a portion of said track circuit current conducted through sad shunt path means and producing a detection signal; and processing means for receiving said detection signal and producing a display signal to operate said traffic control indicators.

2. The system of claim 1 wherein said sensor means has at least one toroid constructed of a magnetically permeable material and generally defining an opening for at least partially circumscribing at least a portion of an axle of said wheel and axle set.

3. The system of claim 2 wherein said shunt path means comprises two railway wheel and axle sets, said sensor means comprising a first toroid mounted about a first axle of said two railway vehicle wheel and axle sets and a second toroid mounted about a second axle of said two railway vehicle wheel and axle sets, whereby respective portions of said track circuit current passing through said first axle and said second axle are simultaneously detected by said sensor means.

4. The system of claim 1 wherein said processing means comprises the serial combination of:

code detection and discrimination circuitry receiving said detection signal and producing an output signal containing track code information; and a track code interpreter circuit which receives said output signal and produces said display signal.

5. The system of claim 1 wherein said sensor means comprises a core constructed of a magnetically permeable material, said core being mounted between said axle and a rail such that a portion of a wheel attached to said axle passes through an opening defined by said core.

6. The system of claim 5 wherein said core is mounted generally parallel to said rail.

7. A railway vehicle cab signalling system for providing electrical signals to operate on-board traffic control indicators based upon coded track circuit signals carried by a track circuit current, said system comprising:

shunt path means comprising at least one railway vehicle wheel and axle set for conducting at least a portion of said track circuit current;

sensor means adjacent said shunt path means for detecting said track circuit current and producing a detection signal;

said sensor means having at least one toroid constructed of two generally semicircular members generally defining an opening for at least partially circumscribing at least a portion of said axle of said wheel and axle set; and processing means for receiving said detection signal and producing a display signal to operate said traffic control indicators.

8. A railway vehicle cab signaling system for providing electrical signals to operate on-board traffic control indicators based upon coded track circuit signals carried by a track circuit current, said system comprising:

shunt path means comprising at least one railway vehicle wheel and axle set for conducting at least a portion of said track circuit current;

sensor means adjacent said shunt path means for detecting said track circuit current and producing a detection signal;

said sensor means having at least one toroid generally defining an opening for at least partially circumscribing at least a portion of an axle of said wheel and axle set;

said toroid having a winding thereon to form a current transformer; and processing means for receiving said detection signal and producing a display signal to operate said traffic control indicators.

9. A railway vehicle cab signalling system for providing electrical signals to operate on-board traffic control indicators based upon coded track circuit signals carried by a track circuit current, said system comprising:

shunt path means comprising at least one railway vehicle wheel and axle set for conducting at least a portion of said track circuit current;

sensor means adjacent said shunt path means for detecting said track circuit current and producing a detection signal;

said sensor means having at least one toroid generally defining an opening for at least partially circumscribing at least a portion of an axle of said wheel and axle set;

said toroid further defining a gap, said sensor means further comprising a magnetic field sensor mounted within said gap; and processing means for receiving said detection signal and producing a display signal to operate said traffic control indicators.

10. A railway vehicle cab signalling system for providing electrical signals to operate on-board traffic control indicators based upon coded track circuit signals carried by a track circuit current, said system comprising:

shunt path means comprising at least one railway vehicle wheel and axle set for conducting at least a portion of said track circuit current;

sensor means adjacent said shunt path means for detecting said track circuit current and producing a detection signal;

said sensor means comprising a transformer having a toroidal core, said said transformer mounted encircling an axle of said railway vehicle wheel and axle set; and processing means for receiving said detection signal and producing a display signal to operate said traffic control indicators.

11. A method of railway vehicle cab signalling comprising the steps of:

(a) establishing at least one shunt path on-board a railway vehicle conducting at least a portion of a track circuit signal current carrying a coded track circuit signal;

(b) detecting said portion of said track circuit current conducting through said shunt path;

(c) providing a track circuit current detection signal analogous to said track circuit current;

(d) isolating said coded track circuit signal from said track circuit current detection signal; and (e) interpreting said track circuit signal to operate traffic control indicators located on-board said railway vehicle.

12. The method of claim 11 further comprising the step between steps (d) and (e) of producing a digital representation of a track circuit code based on said coded track circuit signal.

13. The method of claim 11 further comprising the steps of:

(f) detecting a portion of a modulated carrier cab signalling current conducting through said shunt path;

(g) providing a modulated carrier detection signal analogous to said modulated carrier cab signalling current;

(h) isolating a coded cab signalling signal from said modulated carrier detection signal;

(i) comparing said coded cab signalling signal with said coded track circuit signal.

14. The method of claim 11 wherein said portion of said track circuit current is detected in step (b) by electromagnetic induction.

15. The method of claim 11 wherein said portion of said track circuit current is detected in step (b) by detecting a magnetic field encircling said shunt path.

* * * * *

UNITED STATES PATENT AND TRADEMARK OFFICE

CERTIFICATE OF CORRECTION

PATENT NO. : 5,263,670

DATED : November 23, 1993

INVENTOR(S) : MICHAEL E. COLBAUGH, RAYMOND C. FRANKE

It is certified that error appears in the above-indentified patent and that said Letters Patent is hereby corrected as shown below:

Column 5, line 61, change "sad" to --said--.

Column 6, line 45, change "signaling" to --signalling--.

Signed and Sealed this

Sixteenth Day of August, 1994

*Attest:*

*Attesting Officer*

BRUCE LEHMAN

*Commissioner of Patents and Trademarks*